US010358616B2

(12) United States Patent
Gahagan et al.

(10) Patent No.: US 10,358,616 B2
(45) Date of Patent: Jul. 23, 2019

(54) LUBRICANTS CONTAINING QUATERNARY AMMONIUM COMPOUNDS

(71) Applicant: The Lubrizol Corporation, Wickliffe, OH (US)

(72) Inventors: Michael P. Gahagan, Derby (GB); Peter Miatt, Allestree (GB)

(73) Assignee: THE LUBRIZOL CORPORATION, Wickliffe, OH (US)

( * ) Notice: Subject to any disclaimer, the term of this patent is extended or adjusted under 35 U.S.C. 154(b) by 0 days.

(21) Appl. No.: 15/563,758

(22) PCT Filed: Apr. 5, 2016

(86) PCT No.: PCT/US2016/026010
§ 371 (c)(1),
(2) Date: Oct. 2, 2017

(87) PCT Pub. No.: WO2016/164345
PCT Pub. Date: Oct. 13, 2016

(65) Prior Publication Data

US 2018/0066202 A1 Mar. 8, 2018

Related U.S. Application Data

(60) Provisional application No. 62/145,206, filed on Apr. 9, 2015.

(51) Int. Cl.

| | |
|---|---|
| ***C10M 133/04*** | (2006.01) |
| ***C10M 133/16*** | (2006.01) |
| ***C10M 133/44*** | (2006.01) |
| ***C10M 141/08*** | (2006.01) |
| ***C10M 169/04*** | (2006.01) |

(52) U.S. Cl.
CPC ..... *C10M 133/04* (2013.01); *C10M 133/16* (2013.01); *C10M 133/44* (2013.01); *C10M 141/08* (2013.01); *C10M 169/048* (2013.01); *C10M 2215/08* (2013.01); *C10M 2215/086* (2013.01); *C10M 2215/223* (2013.01); *C10M 2215/28* (2013.01); *C10M 2219/106* (2013.01); *C10N 2230/02* (2013.01); *C10N 2230/06* (2013.01); *C10N 2230/12* (2013.01); *C10N 2240/04* (2013.01); *C10N 2240/042* (2013.01)

(58) Field of Classification Search
None
See application file for complete search history.

(56) References Cited

U.S. PATENT DOCUMENTS

| | | | | |
|---|---|---|---|---|
| 2012/0247514 | A1* | 10/2012 | Butke | C10M 133/56 134/22.11 |
| 2013/0133243 | A1 | 5/2013 | Cornelia Roeger-Goepfert et al. | |
| 2014/0057818 | A1 | 2/2014 | Barton et al. | |

FOREIGN PATENT DOCUMENTS

| | | | |
|---|---|---|---|
| WO | 2012/177529 | A1 | 12/2012 |

* cited by examiner

*Primary Examiner* — Vishal V Vasisth
(74) *Attorney, Agent, or Firm* — Michael Miller; David Shold

(57) ABSTRACT

A driveline device is lubricated with a composition of an oil of lubricating viscosity and an oil-soluble quaternary ammonium compound, such as a succinimide or succinamide material or dispersant further containing a quaternary nitrogen atom, and a thiadiazole compound.

12 Claims, No Drawings

LUBRICANTS CONTAINING QUATERNARY AMMONIUM COMPOUNDS

CROSS REFERENCE TO RELATED APPLICATION

This application claims priority from PCT Application Serial No. PCT/US2016/026010 filed on Apr. 5, 2016, which claims the benefit of U.S. Provisional Application No. 62/145,206 filed on Apr. 9, 2015, both of which are incorporated in their entirety by reference herein.

BACKGROUND

The disclosed technology relates to lubricants containing quaternary ammonium compounds, particularly useful in driveline applications such as dual clutch transmissions. The quaternary ammonium compound comprises a quaternary ammonium salt such as that of a hydrocarbyl succinimide.

Transmissions may include automatic transmissions as well as dual clutch transmissions, the latter also known as double clutch or twin clutch transmissions, of a variety of types are known. For example, "Transmission Options," in *Automotive Engineering International*, July, 2001, discusses on pages 67-68 double-clutch transmissions and certain of their limitations. The present invention seeks to fulfill the requirements of smooth and efficient lubrication of a driveline device, including an automatic transmission such as, in particular, a dual clutch transmission ("DCT"). A single lubricant, as described herein, simultaneously satisfies the multiple requirements of such a transmission, including lubrication of gearing, typical of a manual transmission, and lubrication of gear synchronizers, also typical of a manual transmission, while also lubricating a wet clutch component, such as a slipping start-up clutch, which is characteristic of an automatic transmission with all the challenging requirements associated therewith. In particular, the gears of the DCT require pitting protection; the synchronizers require a fluid that provides good durability of shifting as well as having the proper friction curve parameters; and the clutches for two parallel input shafts containing the gears require proper lubrication. The lubricant should also have good corrosion performance, that is, not lead to excessive corrosion of copper-containing parts with which it may come in contact.

U.S. Pat. No. 6,528,458, Tipton et al., Mar. 4, 2003, discloses a method for lubricating a dual clutch transmission. The lubricating composition comprises, among other components, oil, a friction modifier, and a dispersant such as (among others) succinimide dispersants.

U.S. Pat. No. 8,153,570, Apr. 10, 2012, and U.S. Pat. No. 8,476,207, Jul. 2, 2013, Barton et al., disclose quaternary ammonium salt detergents for use in lubricating compositions or fuels. Example 2 discloses the reaction product of a dimethylaminopropylamine succinimide with dimethyl sulphate to result in a quaternary ammonium salt.

U.S. Publication 2012/0247514, Butke et al., Oct. 4, 2012, discloses a lubricant system clean-up composition comprising a dispersant component comprising a succinimide dispersant and/or a quaternary ammonium salt dispersant. It may be used in a hydraulic system. The quaternizing agent may be, among others, dialkyl sulfates.

U.S. Publication 2008/0113890, Moreton et al., May 15, 2008, discloses a quaternary ammonium salt detergent made from the reaction product of the reaction of (a) polyalkene-substituted amine having at least one tertiary amino group; and (b) a quaternizing agent; and its use in a fuel composition. The quaternizing agent may be a dialkyl sulfate. An engine may be lubricated by an oil of lubricating viscosity and the quaternary ammonium salt.

U.S. Pat. No. 4,171,959, Vartanian, Oct. 23, 1979, discloses fuel compositions containing quaternary ammonium salts of succinimides. The X anion may be the anion of an acid, i.e., a halide or organic acid such as sulfonate or carboxylate.

U.S. Pat. No. 5,254,138, Kurek, Oct. 19, 1993, discloses a fuel composition containing a quaternary ammonium salt. There appears to be a quaternized succinimide material wherein the anion $Z^-$ may be, among others, methylsulfate.

U.S. Publication 2012/0101012, Delbridge, Apr. 26, 2012, discloses ashless or reduced ash quaternary detergents as a lubricant additive component for internal combustion engines. Use of the material to lubricate a driveline component (e.g., automatic or manual transmission) is mentioned.

U.S. Publication 2007/0155636, de Vries, Jul. 5, 2007, discloses a lubricating oil additive and lubricating oil composition with good cleaning performance. The additive is a quaternary ammonium salt having a base number of at least 10. The lubricating oil composition can be used in internal combustion engine lubricating oil, driving system lubricating oil (such as manual transmission oil, differential gear oil, or automatic transmission oil) or others.

U.S. Pat. No. 3,749,695, de Vries, Jul. 31, 1973, discloses lubricating compositions containing effective detergents and dispersants which are the reaction products of hydrocarbyl-substituted polyamines or succinimides with alkane sultones. The lubricating compositions are used in internal combustion engines.

SUMMARY

The use of a lubricant as described herein provides low levels of copper corrosion while retaining good frictional properties in the lubrication of a driveline device such as a dual clutch transmission or automatic transmission.

The disclosed technology provides a method for lubricating a driveline device, comprising supplying thereto a composition comprising: (a) an oil of lubricating viscosity; and (b) an oil-soluble quaternary ammonium compound comprising a hydrocarbyl-substituted imide or amide further containing a quaternary nitrogen atom and a carbon-containing anion other than an acetate anion or other than an alkyl carboxylate anion; and (c) a thiadiazole compound.

DETAILED DESCRIPTION

Various preferred features and embodiments will be described below by way of non-limiting illustration.

One component of the disclosed technology is an oil of lubricating viscosity, also referred to as a base oil. The base oil may be selected from any of the base oils in Groups I-V of the American Petroleum Institute (API) Base Oil Interchangeability Guidelines (2011), namely

| Base Oil Category | Sulfur (%) | Saturates (%) | Viscosity Index |
|---|---|---|---|
| Group I | >0.03 and/or | <90 | 80 to less than 120 |
| Group II | ≤0.03 and | ≥90 | 80 to less than 120 |
| Group III | ≤0.03 and | ≥90 | ≥120 |
| Group IV | All polyalphaolefins (PAOs) | | |
| Group V | All others not included in Groups I, II, III or IV | | |

Groups I, II and III are mineral oil base stocks. Other generally recognized categories of base oils may be used, even if not officially identified by the API: Group II+, referring to materials of Group II having a viscosity index of 110-119 and lower volatility than other Group II oils; and Group III+, referring to materials of Group III having a viscosity index greater than or equal to 130. The oil of lubricating viscosity can include natural or synthetic oils and mixtures thereof. Mixture of mineral oil and synthetic oils, e.g., polyalphaolefin oils and/or polyester oils, may be used.

Natural oils include animal oils and vegetable oils (e.g. vegetable acid esters) as well as mineral lubricating oils such as liquid petroleum oils and solvent-treated or acid treated mineral lubricating oils of the paraffinic, naphthenic, or mixed paraffinicnapthenic types. Hydrotreated or hydrocracked oils are also useful oils of lubricating viscosity. Oils of lubricating viscosity derived from coal or shale are also useful.

Synthetic oils include hydrocarbon oils and halosubstituted hydrocarbon oils such as polymerized and interpolymerized olefins and mixtures thereof, alkylbenzenes, polyphenyl, alkylated diphenyl ethers, and alkylated diphenyl sulfides and their derivatives, analogs and homologues thereof. Alkylene oxide polymers and interpolymers and derivatives thereof, and those where terminal hydroxyl groups have been modified by, e.g., esterification or etherification, are other classes of synthetic lubricating oils. Other suitable synthetic lubricating oils comprise esters of dicarboxylic acids and those made from C5 to C12 monocarboxylic acids and polyols or polyol ethers. Other synthetic lubricating oils include liquid esters of phosphorus-containing acids, polymeric tetrahy-drofurans, silicon-based oils such as poly-alkyl-, polyaryl-, polyalkoxy-, or polyaryloxy-siloxane oils, and silicate oils.

Other synthetic oils include those produced by Fischer-Tropsch reactions, typically hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures thereof) of the types disclosed hereinabove can used. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils often are additionally processed to remove spent additives and oil breakdown products.

The amount of oil will typically be the amount to equal 100 percent of the composition after the other specified components are accounted for. In certain embodiments the amount may be 50 to 99.5 percent by weight, or 60 to 98, or 70 to 95, or 80 to 92, or 84 to 90 percent. The amount of oil may be calculated so as to include the amounts of diluent oil conventionally contributed by certain of the additives.

A second component is an oil-soluble quaternary ammonium compound comprising a hydrocarbyl-substituted imide or a hydrocarbyl-substituted amide further containing a quaternary nitrogen atom and a carbon-containing anion other than an acetate anion or, alternatively, other than an alkyl carboxylate anion. (By "alkyl carboxylate anion" is meant an anion of the structure R—$COO^-$ where R is an alkyl group; e.g., an alkanoate anion.) As used herein, the term "oil-soluble" means that the material in question may be practically dissolved or dispersed in mineral oil at room temperature, regardless of whether a true solution is obtained on a molecular level. Such solubility may be provided by the presence of a hydrocarbyl group. The extent of solubility will be at least suitable to permit the desired amount of the material in question to be practically provided to a lubricant or a concentrate. With respect to the oil-soluble quaternary ammonium compound, oil-solubility may mean solubility of at least 0.25 percent by weight, or at least 0.5 or 1.0 or 2 percent by weight.

Quaternary nitrogen compounds are known. Ordinarily nitrogen is a trivalent element, forming three covalent bonds to hydrogen or carbon atoms in ammonia or amines: $NH_x R_{3-x}$, where R is a group linked to the nitrogen atom through a carbon atom of the R group. Quaternary nitrogen compounds, on the other hand, comprise a quaternary ammonium ion and a counterion (e.g., hydroxide, halide), represented by the general formula $NR_4^+X^-$. In such materials, the nitrogen has four substantially non-ionizable covalent bonds to carbon atoms. The quaternary cations are permanently charged and are comparatively unaffected by the pH of the medium. They are thus distinguished from ordinary ammonium ions or protonated amines, which materials contain up to three substantially non-ionizable covalent bonds to carbon and one or more acidic hydrogen atoms or protons associated with the nitrogen atom. The ionic quaternary ammonium salts of the present technology will thus be free from acidic protons in the sense that they will have the general structure $NR_4^+X^-$ rather than $HNR_3^+X^-$. However, the molecules overall may (or may not) contain other acidic hydrogen that is titratable as total acid number (TAN), on other portions of the material than the cation. In one embodiment, the quaternary nitrogen is bonded to four carbon atoms by four single bonds, one bond to each. In one embodiment, the quaternary nitrogen is bonded to three carbon atoms by two single bonds and one double bond. In one embodiment the quaternary nitrogen is, and in another embodiment is not, a part of an imidazole or imidazoline structure. In one embodiment the quaternary nitrogen is, and in another embodiment is not, a part of an aromatic ring.

The quaternary ammonium compounds of the disclosed technology will contain a hydrocarbyl substituent, which may contain 12 to 500 carbon atoms, or 24 to 400 carbon atoms, or may have a number average molecular weight of 350 to 5000, or 400 to 2000, or 500 to 1800, such as 1000 or 1500. The hydrocarbyl substituents are further described in connection with the $R^1$ group in the succinimide structures shown below.

The quaternary ammonium compounds may be based on, or prepared from, a hydrocarbyl-substituted succinimide or succinamide. The succinimide or succinamide may be described as a succinimide or succinamide dispersant, particularly if the hydrocarbyl substituent is sufficiently long to provide sufficient oil-solubility to permit the molecule to display dispersant properties. Such a hydrocarbyl group may contain, for instance, at least 24 or at least 30 carbon atoms.

The imide or amide will typically contain contains (prior to quaternization) at least one tertiary amine group. Ordinary non-quaternary succinimide materials, for example, are described in greater detail below, and may include materials of the general structure

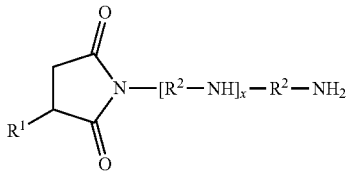

as further described below. However, in order to be particularly useful for the present technology, that is, in order to be able to be quaternized, there should be at least one teriary amine group. That is, at least one of the —NH— groups in the structure may instead be an —NR— group, where R may be an alkyl group.

A particularly suitable starting material may be one having a general structure represented by

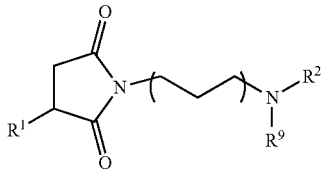

In such structures, $R^1$ may be an alkyl or alkylene group, typically having at least 16 or 24 carbon atoms, which may be attached to the 5-membered ring by a variety of modes of linkages, including various cyclic linkages. The group on the right contains a tertiary amino group, as shown. The linking group, shown here in parentheses, may be a simple propylene group, as shown, or it may be a branched or linear group of 2 to 12 or 3 to 6 carbon atoms, optionally containing one or more oxygen atoms or nitrogen atoms, that is, it may also contain hydroxy or ether groups, or amino groups, either as side groups or within the chain itself (except hydroxy). The groups $R^2$ and $R^9$ on the nitrogen atom independently are typically alkyl groups, such as methyl groups, although they may be longer chain alkyl groups of, e.g., 2 to 18 carbon atoms, or they may be joined together to form a ring such as a 5- or 6-membered ring.

The groups $R^2$ and $R^9$ may also have additional functionality that does not interfere with the quaternization reaction. They may have, for instance oxygen or nitrogen atoms as described for the linking group, above.

In one embodiment, $R^2$ and $R^9$ are both methyl groups. Such a material may be prepared by the condensation of a substituted succinic anhydride with N,N-dimethylpropylenediamine, that is, dimethylaminopropylamine or (more generally where $R^2$ and $R^9$ are alkyl) an N,N-dialkylpropylenediamine. In other embodiments $R^2$ is methyl and $R^9$ may be 2-hydroxy-1-propyl or 2-hydroxy-2-phenylethyl.

The material of the disclosed technology may be quaternized using a sulfur-containing quaternizing agent such that the resulting quaternary ammonium salt will contain a sulfur-containing anion, namely, a sulfate or sulfonate anion. Alternatively, the quaternizing agent may be a dialkyl oxalate such as dimethyl oxalate (to give an alkyl oxalate anion) or an alkyl hydroxybenzoate ester such as a methyl salicylate (to give a hydroxybenxzoate anion). It may be desirable that the anion is other than an acetate anion or, in some embodiments, other than an alkyl carboxylate anion. If an acetate or alkyl carboxylate anion is initially present as the counterion to the quaternary ammonium ion, it may be replaced by a more suitable anion by an exchange reaction, possibly in situ in a lubricant formulation or in a concentrate formulation.

In certain embodiments, the resulting material may contain a cation represented by the structure

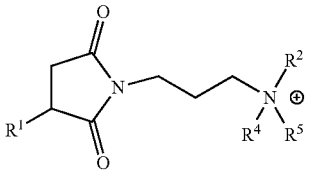

wherein $R^1$ represents a hydrocarbyl group of at least 16 or at least 24 carbon atoms, provided that $R^1$ may be attached to the cyclic imide structure by any of a variety of linkages including cyclic linkages and further provided that (in this structure and in other such structures generally) $R^1$ may be attached to multiple cyclic imide structures; where in $R^2$ is an alkyl group, a hydroxyalkyl group, or an arylalkyl group; $R^4$ is an alkyl group, and $R^5$ is methyl or ethyl.

In certain embodiments the quaternary materials may be of a zwitterionic character, that is, where the anion and the quaternary ammonium ion are covalently bonded within the same molecule. Some such materials may contain a betaine-like structure, where betaine is

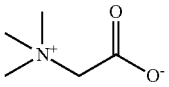

A quaternary ammonium succinimide having a betaine structure may be represented by

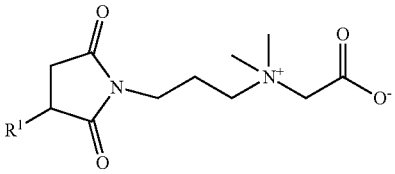

Such materials may be prepared by reaction of the tertiary amine with sodium chloroacetate.

The quaternizing agent may therefore, in certain embodiments, be a sulfur-containing agent containing at least one alkyl group that will be donated or attached to the tertiary amino group of the moiety to be quaternized. In many instances the alkyl group is a methyl group, and the quaternizing agent may thus be a dimethyl sulfate. In some instances a quaternary nitrogen may be prepared using a counterion exchange reaction. For example, a quaternary ammonium compound having an anion of a weak acid, such as an acetate, may undergo a counterion anion exchange reaction with the salt of a strong acid, such as an alkylaryl sulfonic acid. Thus a quaternary ammonium alkaryl sulfonate may be formed from a quaternary ammonium acetate.

The following reaction scheme is illustrative:

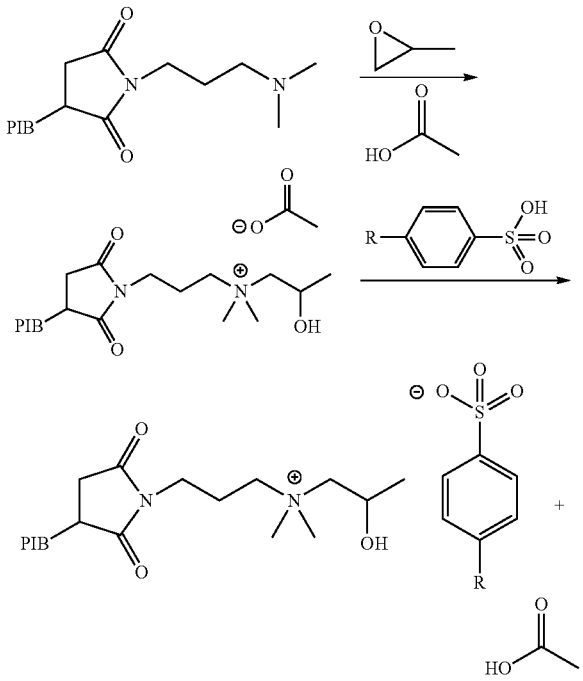

Illustrative sulfates include dimethyl sulfate. After donation of a methyl group, the residual anion is a methyl sulfate anion. Some examples of quaternized succinimide materials such as dispersants with a methyl sulfate (or ethyl sulfate) counterion are represented by the following structures:

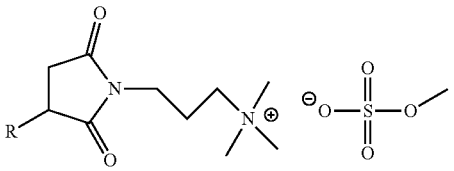

or, somewhat more generally,

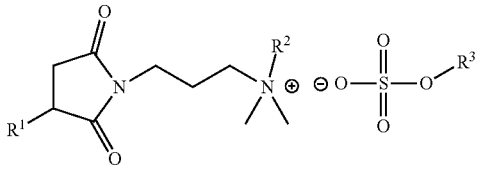

or isomers thereof (or a non-cyclic amide structure corresponding thereto, which may be part of a diamide or an amide-ester group, for instance), wherein $R^1$ represents a hydrocarbyl group of at least about 16 or at least about 24 carbon atoms, provided that $R^1$ may be attached to the cyclic imide structure by any of a variety of linkages including cyclic linkages and further provided that 10 may be attached to multiple cyclic imide structures; and wherein $R^2$ is an alkyl group, a hydroxyalkyl group, or an arylalkyl group; and wherein $R^3$ is methyl or ethyl.

Illustrative sulfonates include alkylsulfonates, arysulfonates, and aralkyl sulfonates, such as methylbenzyl sulfonate and methyltolylsulfonate. Examples of quaternized materials such as dispersants with a benzylsulfonate or tolylsulfonate counterion are represented by the following structures:

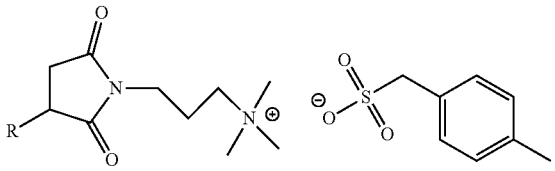

The quaternized material (such as the dispersant) may be prepared by reacting the compound containing a tertiary nitrogen with the suitable sulfur-containing quaternizing agent. For instance, a material in a solvent such as mineral oil may be reacted at elevated temperature (e.g., 50-150° C. or 70 to 130° C. or 80 to 110° C. or 90 to 100° C.) with a stoichiometric or slightly sub-stoichiometric amount of the quaternizing agent. Suitable times may be ½ to 6 hours or 1 to 5 hours or 2 to 4 hours or about 3 hours.

The amount of the quaternized compound in a lubricant formulation may be 0.1 to 5 percent or, or 0.3 to 5, or 0.5 to 5 percent by weight, or 1 to 4 percent, 2 to 3.5 percent, 2.2 to 2.8 percent, or 2.3 to 2.5 percent by weight, or in other embodiments 0.05 to 1 percent or 0.1 to 1, or 0.25 to 0.75 or 0.3 to 0.6 percent by weight. Materials with longer chain hydrocarbyl groups may typically be used at the relatively higher concentrations, and those with shorter chain groups at the lower concentrations.

Other components that may be typically found in a lubricant, especially a lubricant for a driveline device such as a transmission or an automatic transmission or a dual clutch transmission may also optionally be present in lubricants of the disclosed technology. They may be present in conventional amounts.

One optional component that may be present is a conventional dispersant, that is, a dispersant other than a quaternized material or dispersant as described herein. Dispersants are well known in the field of lubricants and include primarily what is known as ashless dispersants and polymeric dispersants. Ashless dispersants are so called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

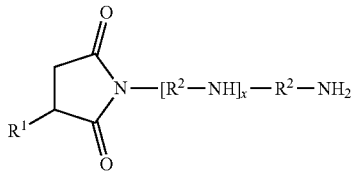

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

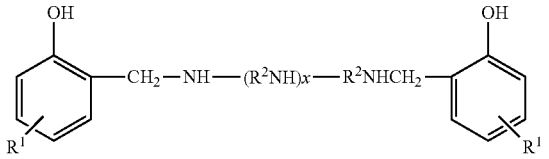

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants may be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of the optional conventional dispersant, if present, in a fully formulated lubricant of the present technology may be at least 0.1% of the lubricant composition, or at least 0.3% or 0.5% or 1%, and in certain embodiments at most 9% or 8% or 6% or 4% or 3% or 2% by weight. These amounts may be in addition to the amount of the above-described quaternary material or dispersant.

The composition of the disclosed technology will also contain a thiadiazole compound. Examples of such materials include dimercaptothiadozoles ("DMTD"); their preparation is described in greater detail in U.S. Pat. No. 5,298,177, see columns 42 through 47. In summary, the dimercaptothiadiazoles which can be utilized in the present technology typically are soluble forms or derivatives of DMTD. Materials which can be starting materials for the preparation of oil-soluble derivatives containing the dimercaptothiadiazole nucleus can include 2,5-dimercapto-[1,3,4]-thiadiazole, 3,5-dimercapto-[1,2,4]-thiadiazole, 3,4-dimercapto-[1,2,5]-thiadiazole, and 4,-5-dimercapto-[1,2,3]-thiadiazole. Of these the most readily available is 2,5-dimercapto-[1,3,4]-thiadiazole.

DMTDs are conveniently prepared by the reaction of one mole of hydrazine, or a hydrazine salt, with two moles of carbon disulfide in an alkaline medium, followed by acidification. For the preparation of oil-soluble derivatives of DMTD, it is possible to utilize already prepared DMTD or to prepare the DMTD in situ and subsequently adding a material to be reacted with DMTD.

U.S. Pat. Nos. 2,719,125; 2,719,126; and 3,087,937 describe the preparation of various 2,5-bis-(hydrocarbon dithio)-1,3,4-thiadiazoles and 2-hydrocarbyldithio-5-mercapto-[1,3,4]-thiadiazoles. The hydrocarbon group may be aliphatic or aromatic, including cyclic, alicyclic, aralkyl, aryl and alkaryl. Such polysulfides can be represented by the following general formula

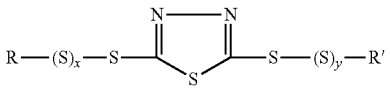

wherein R and R' may be the same or different hydrocarbyl groups which may, generally, be as defined for the R groups of the above hydrocarbyl amine salts, and x and y be integers from 0 to 8, and the sum of x and y is at least 1. Alternatively, in certain embodiments, R' can be H when y is 0. A process for preparing such derivatives is described in U.S. Pat. No. 2,191,125, comprising reacting DMTD with a suitable sulfenyl chloride or by reacting the dimercapto dithiazole with chlorine and reacting the resulting disulfenyl chloride with a primary or tertiary mercaptan. U.S. Pat. No. 3,087,932 further describes a one-step process for preparing 2,5-bis (hydrocarbyldithio)-1,3,4-thiadiazole. As another variant, carboxylic esters of DMTD are described in U.S. Pat. No. 2,760,933. Similarly, condensation products of alpha-halogenated aliphatic monocarboxylic acids having at least 10 carbon atoms with DMTD are described in U.S. Pat. No. 2,836,564, while U.S. Pat. No. 2,765,289 describes products obtained by reacting DMTD with an aldehyde and a diaryl amine in molar proportions of from about 1:1:1 to about 1:4:4. The DMTD materials may also be present as salts such as amine salts. Further derivatives are also described in greater detail in the aforementioned U.S. Pat. No. 5,298,177.

In one embodiment, the thiazole compound may be the reaction product of a phenol with an aldehyde and a dimercaptothiadiazole. The phenol may be an alkyl phenol wherein the alkyl group contains at least about 6, e.g., 6 to 24, or 6, or 7, to 12 carbon atoms. The aldehyde may be an aldehyde containing 1 to 7 carbon atoms or an aldehyde synthon, such as formaldehyde. In one embodiment, the aldehyde is formaldehyde or paraformaldehyde. The aldehyde, phenol and dimercaptothiadiazole are typically reacted by mixing them at a temperature up to about 150° C. such as 50° C. to 130° C., in molar ratios of 0.5 to 2 moles of phenol and 0.5 to 2 moles of aldehyde per mole of dimercaptothiadiazole. In one embodiment, the three reagents are reacted in equal molar amounts. The product may be described as an alkylhydroxyphenylmethylthio-substituted [1,3,4]-thiadiazole; the alkyl moiety may be, among others, hexyl, heptyl, octyl, or nonyl.

Useful thiadiazole compounds thus may include 2-alkyldithio-5-mercapto-[1,3,4]-thiadiazoles, 2,5-bis(alkyldithio) [1,3,4]-thiadiazoles, 2-alkylhydroxyphenylmethylthio-5-mercapto-[1,3,4]-thiadiazoles, and mixtures thereof.

Another useful DMTD derivative is obtained by reacting DMTD with an oil-soluble dispersant, such as a substantially neutral or acidic carboxylic dispersant, e.g., a succinimide dispersant (other than a quaternized species as described herein) or a succinic ester dispersant, in a diluent, by heating the mixture above about 100° C. This procedure and the derivatives produced thereby are described in U.S. Pat. No. 4,136,043, as are various types of suitable dispersants.

Examples of a suitable dimercaptothiadiazole include 2,5-dimercapto-1,3,4-thiadiazole or a hydrocarbyl-substituted 2,5-dimercapto-1,3-4-thiadiazole. In several embodiments the number of carbon atoms on the hydrocarbyl-substituent group includes 1 to 30, 2 to 25, 4 to 20, or 6 to 16. Examples of suitable 2,5-bis(alkyl-dithio)-1,3,4-thiadiazoles include 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiatole, 2,5-bis(tert-octadecyldithio)-1,3,4-thiadiazole, 2,5-bis(tert-nonadecyldithio)-1,3,4-thiadiazole or 2,5-bis(tert-eicosyldithio)-1,3,4-thiadiazole, or oligomers thereof.

The amount of the thiadiazole may, in certain embodiments, be 0.01 to 5, or 0.05 to 2, or 0.1 to 1 percent by weight of the composition, depending in part on the identity of the particular compound. For instance, if the thiadiazole compound is as described for the structure shown above, the amount may be 0.01 to 1 percent, or 0.02 to 0.4 or 0.03 to 0.1 percent by weight. Alternatively, if the thiadiazole is reacted with a nitrogen-containing dispersant, the total weight of the combined product may be significantly higher in order to impart the same active thiadiazole chemistry; for instance, 0.1 to 5 percent, or 0.2 to 2 or 0.3 to 1 or 0.4 to 0.6 percent by weight. The amount of sulfur provided by the thiadiazole material may be 0.003 to 0.3 weight percent, or 0.006 to 0.12 weight percent, or 0.009 to 0.03 weight percent. The amounts will be proportionally higher in a concentrate.

The composition of the present invention may also optionally contain one or more detergents, or in certain applications detergents may be omitted. Detergents are typically overbased materials, otherwise referred to as overbased or superbased salts, which are generally homogeneous Newtonian systems having a metal content in excess of that which would be present for neutralization according to the stoichiometry of the metal and the detergent anion. The amount of excess metal may be expressed in terms of metal ratio, that is, the ratio of the total equivalents of the metal to the equivalents of the acidic organic compound. Overbased materials are prepared by reacting an acidic material (such as carbon dioxide) with an acidic organic compound, an inert reaction medium (e.g., mineral oil), a stoichiometric excess of a metal base, and a promoter such as a phenol or alcohol. The acidic organic material will normally have a sufficient number of carbon atoms to provide oil-solubility.

Overbased detergents may be characterized by Total Base Number (TBN, ASTM D2896), the amount of strong acid needed to neutralize all of the material's basicity, expressed as mg KOH per gram of sample. Since overbased detergents are commonly provided in a form which contains diluent oil, for the purpose of this document, TBN is to be recalculated to an oil-free basis. Some useful detergents may have a TBN of 100 to 800, or 150 to 750, or, 400 to 700.

The metal compounds useful in making the basic metal salts are generally any Group 1 or Group 2 metal compounds (CAS version of the Periodic Table of the Elements). Examples include alkali metals such as sodium, potassium, lithium, copper, magnesium, calcium, barium, zinc, and cadmium. In one embodiment the metals are sodium, magnesium, or calcium. The anionic portion of the salt can be hydroxide, oxide, carbonate, borate, or nitrate, often carbonate.

In one embodiment the lubricant can contain an overbased sulfonate detergent. Suitable sulfonic acids include sulfonic and thiosulfonic acids, including mono- or polynuclear aromatic or cycloaliphatic compounds. Certain oil-soluble sulfonates can be represented by $R^2$-T-$(SO_3^-)_a$ or $R^3$—$(SO_3^-)_b$, where a and b are each at least one; T is a cyclic nucleus such as benzene or toluene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. The groups T, $R^2$, and $R^3$ can also contain other inorganic or organic substituents. In one embodiment the sulfonate detergent may be a predominantly linear alkylbenzenesulfonate detergent having a metal ratio of at least 8 as described in paragraphs [0026] to [0037] of US Patent Application 2005065045. In some embodiments the linear alkyl group may be attached to the benzene ring anywhere along the linear chain of the alkyl group, but often in the 2, 3 or 4 position of the linear chain, and in some instances predominantly in the 2 position.

Another overbased material is an overbased phenate detergent. The phenols useful in making phenate detergents can be represented by $(R^1)_a$—Ar—$(OH)_b$, where $R^1$ is an aliphatic hydrocarbyl group of 4 to 400 or 6 to 80 or 6 to 30 or 8 to 25 or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 8 aliphatic carbon atoms provided by the $R^1$ groups for each phenol compound. Phenate detergents are also sometimes provided as sulfur-bridged species.

In one embodiment, the overbased material is an overbased saligenin detergent. Overbased saligenin detergents are sometimes overbased magnesium salts which are based on saligenin derivatives. A general example of a saligenin derivative can be represented by the formula

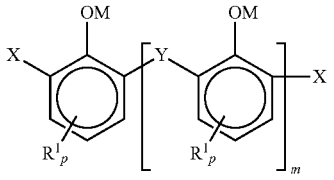

where X is —CHO or —$CH_2OH$, Y is —$CH_2$— or —$CH_2OCH_2$—, and the —CHO groups typically comprise at least 10 mole percent of the X and Y groups; M is hydrogen, ammonium, or a valence of a metal ion (that is, if M is multivalent, one of the valences is satisfied by the illustrated structure and other valences are satisfied by other species such as anions or by another instance of the same structure), $R^1$ is a hydrocarbyl group of 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a compound comprising at least one unit of formula (I) or formula (II) and each end of the compound having a terminal group of formula (III) or (IV):

(I)

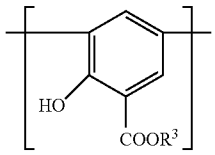

(II)

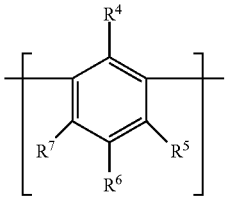

(III)

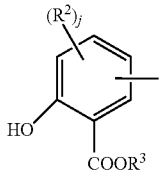

(IV)

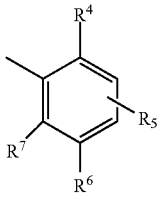

such groups being linked by divalent bridging groups A, which may be the same or different. In formulas (I)-(IV) $R^3$ is hydrogen, a hydrocarbyl group, or a valence of a metal ion; $R^2$ is hydroxyl or a hydrocarbyl group, and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is 0.1:1 to 2:1. The divalent bridging group "A," which may be the same or different in each occurrence, includes —$CH_2$— and —$CH_2OCH_2$—, either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are based on an anionic group which, in one embodiment, may have the structure

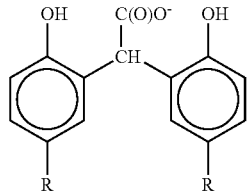

wherein each R is independently an alkyl group containing at least 4 or 8 carbon atoms, provided that the total number of carbon atoms in all such R groups is at least 12 or 16 or 24. Alternatively, each R can be an olefin polymer substituent. The acidic material from which the overbased glyoxylate detergent is prepared may be the condensation product of a hydroxyaromatic material such as a hydrocarbyl-substituted phenol with a carboxylic reactant such as glyoxylic acid or another omega-oxoalkanoic acid. Overbased glyoxylic detergents and their methods of preparation are disclosed in greater detail in U.S. Pat. No. 6,310,011 and references cited therein.

The overbased detergent can also be an overbased salicylate, e.g., an alkali metal or alkaline earth metal salt of a substituted salicylic acid. The salicylic acids may be hydrocarbyl-substituted wherein each substituent contains an average of at least 8 carbon atoms per substituent and 1 to 3 substituents per molecule. The substituents can be polyalkene substituents. In one embodiment, the hydrocarbyl substituent group contains 7 to 300 carbon atoms and can be an alkyl group having a molecular weight of 150 to 2000. Overbased salicylate detergents and their methods of preparation are disclosed in U.S. Pat. Nos. 4,719,023 and 3,372,116.

Other overbased detergents can include overbased detergents having a Mannick base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of C12 aliphatic hydrocarbyl groups (e.g., less than 1%, 0.1%, or 0.01% by weight of the substituents are C12 aliphatic hydrocarbyl groups). In some embodiments such hydrocarbyl substituents contain at least 14 or at least 18 carbon atoms.

The amount of the overbased detergent, in the formulations of the present technology, may be 0 to 5 weight percent on an oil free basis, typically at least 0.05 weight percent, or at least 0.07 or 0.1 weight percent, and up to 5, or 3, or 1 or 0.5 weight percent. Either a single detergent or multiple detergents can be present.

Another optional component that may be used in the composition used in the present technology is a friction modifier. Friction modifiers are well known to those skilled in the art and may include:

fatty phosphites
fatty acid amides
fatty epoxides
borated fatty epoxides
fatty amines glycerol esters
borated glycerol esters
alkoxylated fatty
oxazolines
hydroxyalkyl amides
dialkyl tartrates
borated alkoxylated fatty amines
metal salts of fatty acids
sulfurized olefins
fatty imidazolines
condensation products of carboxylic acids and polyalkylene-polyamines
metal salts of alkyl salicylates
amine salts of alkylphosphoric acids
ethoxylated alcohols
imidazolines
polyhydroxy tertiary amines
molybdenum compounds
and mixtures of two or more thereof.

Representatives of each of these types of friction modifiers are known and are commercially available. For instance, fatty phosphites may be generally of the formula $(RO)_2PHO$ or (RO)(HO)PHO where R may be an alkyl or alkenyl group of sufficient length to impart oil solubility. Suitable phosphites are available commercially and may be synthesized as described in U.S. Pat. No. 4,752,416.

Borated fatty epoxides are disclosed in Canadian Patent No. 1,188,704. They may be prepared by reacting a boron source such as boric acid or boron trioxide with a fatty epoxide which may contain at least 8 carbon atoms. Non-borated fatty epoxides may also be useful.

Borated amines are disclosed in U.S. Pat. No. 4,622,158. Borated amines (including borated alkoxylated fatty amines) may be prepared by the reaction of a boron compound, as above, with the corresponding amines, including simple fatty amines and hydroxy containing tertiary amines. The amines may include commercial alkoxylated fatty amines as described in U.S. Pat. No. 4,741,848.

Alkoxylated fatty amines and fatty amines themselves (such as oleylamine) may be useful as friction modifiers. These amines are commercially available.

Both borated and unborated fatty acid esters of glycerol may be used as friction modifiers. Borated fatty acid esters of glycerol may be prepared by borating a fatty acid ester of glycerol with a boron source such as boric acid. Fatty acid esters of glycerol themselves may be prepared by a variety of methods well known in the art. Many of these esters, such as glycerol monooleate and glycerol tallowate, are manufactured on a commercial scale. Commercial glycerol monooleates may contain a mixture of 45% to 55% by weight monoester and 55% to 45% by weight diester.

Fatty acids may be used as their metal salts, amides, and imidazolines. The fatty acids may contain 6 to 24, or 8 to 18 carbon atoms. An example is oleic acid.

Amides of fatty acids may be prepared by condensation with ammonia or with primary or secondary amines such as diethylamine and diethanolamine. Fatty imidazolines may include the cyclic condensation product of an acid with a diamine or polyamine such as a polyethylenepolyamine. In one embodiment, the friction modifier may be the condensation product of a C8 to C24 fatty acid with a polyalkylene polyamine, for example, the product of isostearic acid with tetraethylenepentamine. The condensation products may be imidazolines or amides.

The fatty acid may be present as a zinc salt, which may be acidic, neutral or basic (overbased). These salts may be prepared from the reaction of a zinc containing reagent, e.g., zinc oxide, with a carboxylic acid or salt thereof. Suitable carboxylic acids include stearyl, oleyl, linoleyl, or palmityl acids. Salts wherein the zinc is present from 1.1 to 1.8 times (e.g., 1.3 to 1.6 times) the stoichiometric amount may be used. These zinc carboxylates are known in the art and are described in U.S. Pat. No. 3,367,869. Metal salts may also include calcium salts, which may be overbased.

Sulfurized olefins are also well known commercial materials used as friction modifiers. A suitable sulfurized olefin may be prepared as described in U.S. Pat. Nos. 4,957,651 and 4,959,168. A cosulfurized mixture of 2 or more reactants may be selected from a fatty acid ester of a polyhydric alcohol, a fatty acid, an olefin, and a fatty acid ester of a monohydric alcohol. The olefin component may be an aliphatic olefin, which may contain 4 to 40 carbon atoms. Mixtures of these olefins are commercially available. The sulfurizing agents useful in the process of the present technology include elemental sulfur, hydrogen sulfide, sulfur halide plus sodium sulfide, and a mixture of hydrogen sulfide and sulfur or sulfur dioxide.

Metal salts of alkyl salicylates include calcium and other salts of long chain (e.g. C12 to C16) alkyl-substituted salicylic acids.

Amine salts of alkylphosphoric acids include salts of oleyl and other long chain esters of phosphoric acid, with amines such as tertiary-aliphatic primary amines, sold under the tradename Primene™.

While friction modifiers, in general, may be used to reduce, increase, or otherwise modify friction, friction modifiers are often used in transmissions having wet clutches to impart a balanced, stable dynamic coefficient of friction. Appropriate friction will provide smooth engagement of the clutch without grabbiness or shudder. Such friction modifiers may include N-alkyl propanediamine amides and esters, oxalic acid bis-amides or amide-esters, N-(3-dialkylaminepropyl)amides, imides, oxalamides, or sulfonamides, and pyromellitic diimides, as described in US2012-0015855, U.S. Pat. No. 8,501,674, US2012-0021958, US2012-0122744, and WO2012/154708, in addition to friction modifiers mentioned in the above paragraphs.

The amount of the friction modifier, if it is present, may be 0.1 to 1.5 percent by weight of the lubricating composition, such as 0.2 to 1.0 or 0.25 to 0.75 percent.

The compositions of the present technology can also include at least one phosphorus acid, phosphorus acid salt, phosphorus acid ester or derivative thereof, including sulfur-containing analogs, in the amount of 0.002-1.0 weight percent. The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof.

In one embodiment, the phosphorus acid, ester or derivative can be an organic or inorganic phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids. One group of phosphorus compounds are alkylphosphoric acid mono alkyl primary amine salts as represented by the formula

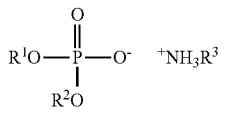

where $R^1$, $R^2$, $R^3$ are alkyl or hydrocarbyl groups or one of $R^1$ and $R^2$ can be H. The materials are usually a 1:1 mixture of dialkyl and monoalkyl phosphoric acid esters. Compounds of this type are described in U.S. Pat. No. 5,354,484.

Eighty-five percent phosphoric acid is an optional material for addition to the fully-formulated compositions and can be included at a level of 0.01 to 0.3 weight percent based on the weight of the composition, such as 0.03 to 0.2 or to 0.1 percent. The phosphoric acid may form a salt with a basic component such as a succinimide dispersant.

Other phosphorus-containing materials that may optionally be present include dialkylphosphites (sometimes referred to as dialkyl hydrogen phosphonates) such as dibutyl phosphite. The amount of dialkylphosphite, if present, may be 0.05 to 2 percent by weight, or 0.1 to 1, or 0.2 to 0.3 percent. Yet other phosphorus materials include phosphorylated hydroxy-substituted triesters of phosphorothioic acids and amine salts thereof, as well as sulfur-free hydroxy-substituted di-esters of phosphoric acid, sulfur-free phosphorylated hydroxy-substituted di- or tri-esters of phosphoric acid, and amine salts thereof. These materials are further described in U.S. patent application US 2008-0182770.

Another optional component may be an antioxidant. Antioxidants encompass phenolic antioxidants, which may be hindered phenolic antioxidants, one or both ortho positions on a phenolic ring being occupied by bulky groups such as t-butyl. The para position may also be occupied by a hydrocarbyl group or a group bridging two aromatic rings. In certain embodiments the para position is occupied by an ester-containing group, such as, for example, an antioxidant of the formula

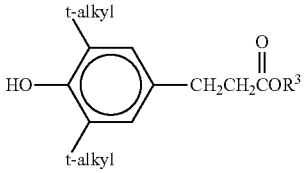

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines. In one embodiment, an aromatic amine antioxidant can comprise an alkylated diphenylamine such as nonylated diphenylamine or a mixture of a di-nonylated and a mono-nonylated diphenylamine.

Antioxidants also include sulfurized olefins such as mono- or disulfides or mixtures thereof. These materials generally have sulfide linkages of 1 to 10 sulfur atoms, e.g., 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents or friction modifiers. U.S. Pat. No. 4,285,822 discloses lubricating oil compositions containing a molybdenum- and sulfur-containing composition prepared by combining a polar solvent, an acidic molybdenum compound and an oil-soluble basic nitrogen compound to form a molybdenum-containing complex and contacting the complex with carbon disulfide to form the molybdenum- and sulfur-containing composition.

Typical amounts of antioxidants will, of course, depend on the specific antioxidant and its individual effectiveness, but illustrative total amounts can be 0.01 to 5 percent by weight or 0.15 to 4.5 percent or 0.2 to 4 percent.

Another optional component frequently used is a viscosity modifier. Viscosity modifiers (VM) and dispersant viscosity modifiers (DVM) are well known. Examples of VMs and DVMs may include polymethacrylates, polyacrylates, polyolefins, hydrogenated vinyl aromatic-diene copolymers (e.g., styrene-butadiene, styrene-isoprene), styrene-maleic ester copolymers, and similar polymeric substances including homopolymers, copolymers, and graft copolymers. The DVM may comprise a nitrogen-containing methacrylate polymer, for example, a nitrogen-containing methacrylate polymer derived from methyl methacrylate and dimethylaminopropyl amine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improvers from Afton, and LZ® 7702, LZ® 7727, LZ® 7725 and LZ® 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 20% by weight. Concentrations of 1 to 12%, or 3 to 10% by weight may be used.

Another optional material may be a supplemental a corrosion inhibitor, that is, one in addition to the thiadiazole described above. Examples of corrosion inhibitors include such materials as octylamine octanoate, condensation products of dodecenyl succinic acid or anhydride or mixtures thereof. The amount of supplemental corrosion inhibitor, if present, may be 0.001 wt % to 10 wt %, 0.005 wt % to 5 wt %, 0.01 wt % to 3 wt % or 0.02 wt % to 2 wt % or 0.1 wt. % to 1.5 wt. % of the lubricating composition. If it is absent or substantially absent, its amount may be less than 0.01 wt. % or less than 0.005 wt. % or less than 0.001 wt. %, e.g., 0.0001 to 0.001 weight percent.

Other materials commonly used in lubricants, particularly for transmissions or dual clutch transmissions, may also be used, or one or more of them be omitted when not needed. Such materials may include pour point depressants, rust inhibitors, anti-foam agents, seal swell agents, and colorants, which may be used in their conventional amounts (e.g., 0.05 to 1 percent in many cases; 0.005 to 0.1 percent for antifoam agents).

The presently disclosed technology, including additive components and lubricants containing them, is useful for lubricating driveline devices, particularly transmissions such as automatic transmissions or, especially, dual clutch transmissions. Dual clutch transmissions, also known as double clutch or twin clutch transmissions, of a variety of types are known. The present invention seeks to fulfill the requirements of smooth and efficient lubrication of a dual clutch transmission, simultaneously satisfies the multiple requirements of such a transmission, including lubrication of gearing, typical of a manual transmission, and lubrication of gear synchronizers, also typical of a manual transmission, while also lubricating a wet clutch component, such as a slipping start-up clutch, which is characteristic of an automatic transmission with all the challenging requirements associated therewith. In particular, the gears of the DCT require pitting protection; the synchronizers require a fluid that provides good durability of shifting as well as having the proper friction curve parameters; and the clutches for two parallel input shafts containing the gears require proper lubrication. The lubricant should also have good corrosion performance, that is, not lead to excessive corrosion of copper-containing parts with which it may come in contact.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is found in paragraphs [0137] to [0141] of published application US 2010-0197536.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The disclosed technology is useful for providing low levels of copper corrosion while retaining good frictional properties in the lubrication of a driveline device, as may be better understood with reference to the following examples.

EXAMPLES

Preparative Example A

Part 1 is prepared from a mixture of polyisobutylene substituted succinic anhydride prepared from 1000 Mn polyisobutylene (21425 g) and diluent oil (3781 g) which are heated with stirring to 110° C. under a nitrogen atmosphere.

Part 2. N,N-dimethylaminopropylamine (DMAPA, 2314 grams) is added slowly to the material of Part 1 over 45 minutes maintaining batch temperature below 115° C. The reaction temperature is increased to 150° C. and held for a further 3 hours. The resulting compound is a DMAPA succinimide.

Part 3. Material prepared as in Preparative Example A, Part 2 (73.4 grams) is heated with stirring to 90° C. Dimethyl sulfate (35 g) is charged to the reaction pot and stirred (300 rpm) under a nitrogen blanket; an exotherm raises batch temperature to 100° C. The reaction is maintained at 100° C. for 3 hours before cooling. The resulting compound is a quaternary ammonium methylsulfate salt. (A small amount of unreacted tertiary amine may also be present to minimize unreacted dimethylsulfate in the product.)

Preparative Example C (Comparative)

Preparative Example A is repeated except the starting material is a succinic anhydride substituted with a C16 alkyl group rather than a 1000 Mn polyisobutene.

Preparative Example F (Comparative)

A reaction product prepared as in Preparative Example A, part 1, 100 parts by weight (pbw), is heated to 80° C. and is charged to a jacketed reaction vessel fitted with stirrer, condenser, feed pump attached to a subline addition pipe, nitrogen line, and mantle, with a temperature controller system. The reaction vessel is heated to 100° C., and DMAPA (10.93 pbw) is charged to the reaction, maintaining the batch temperature below 120° C. The reaction mixture is then heated to 150° C. and held for 3 hours. The resulting product, a non-quaternized succinimide dispersant, is cooled and collected. This material is heated to 75° C. and is charged to a similar reaction vessel, and 2-ethyl hexanol (41 pbw), water (1 pbw) and acetic acid (5.9 pbw) are charged to the vessel and held for 3 hours. Propylene oxide (8.54 pbw) is then charged via a subsurface sparge ring, and the reaction mixture is held at 75° C. for 6 hours. The resulting product, cooled and collected, is a quaternary succinimide salt with an acetate counterion.

Example I (Comparative)

This is a commercially available succinimide dispersant, non-quaternary, prepared from 1000 Mn polyisobutene-substituted succinic anhydride condensed with polyethylenepolyamine and having a total base number of 50.5 (including 40% diluent oil). This material has a mole ratio of CO:N moieties of 1:1.3-1.6.

Preparative Example J

Part 1. A reaction product of Preparative Example A, Part 2 (DMAPA succinimide) (411.3 g), methanol (170 g), and acetic acid (24.3 g) are added to a flask fitted with a thermocouple, nitrogen inlet, and condenser, and are heated at 56° C. under a blanket of nitrogen with stirring 230 r.p.m. Propylene oxide (43 mL, 35.6 g) is introduced (subsurface) to the reaction mixture over a 4 hour period and maintained a further 2 hours before cooling to room temperature.

Part 2. The reaction product of Part 1 (553.1 g) and a C20-24 alkybenzene-sulfonic acid (206.5 g) are heated to 50° C. in diluent oil (429.7 g) and maintained at temperature for 1 hour. A vacuum is applied and distillate is removed as the temperature is increased to 90° C. over 3 hours, collecting 70.6 g distillate. An additional amount of diluent oil (216.5 g) is added at 90° C. and the mixture allowed to stir for 30 minutes before cooling to room temperature. The product is an alkylbenzenesulfonate salt.

Preparative Example K

A material prepared as in Preparative Example A, part 2 (951 g), 2-ethylhexanol (285 g) and water (71 g) are heated to 60° C. under a nitrogen atmosphere with agitation for 30 minutes. Sodium chloroacetate (116.5 g) is charged to the reaction mixture which is then heated to 80° C. for 3.5 hours. The reaction mixture is diluted by 50% with an aromatic solvent (a heavy aromatic naphtha) and filtered to remove sodium chloride. The product contains a betaine structure.

Preparative Example L

A quaternary material is prepared by a procedure analogous to that of Preparative Example A, except the starting amine is di(3-aminopropyl)methylamine and the succinic anhydride is substituted with a C16 alkyl group. The resulting product is represented by the following structure:

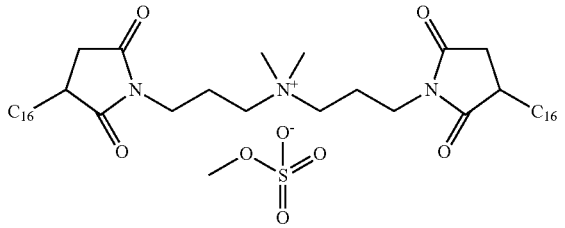

Preparative Example M

Quaternary material with a salicylate counterion. A flask equipped with a stirrer, condenser, and nitrogen feed is charged with 251.4 g of the material from Preparative Example A, part 2 (DMAPA succinimide) and 2-ethylhexanol (418.0 g). Methyl salicylate (52.7 g) is added and the mixture is heated to 100° C. over 1 hour with stirring, then increased to 140° C. and maintained at temperature for 12 hours. The mixture is thereafter cooled.

Preparative Example N

Quaternary material with an oxalate anion. A flask equipped with stirrer, condenser, and nitrogen feed is charged with 330.2 g of material from Preparative Example A, part 2 (DMAPA succinimide) and with 248 g of an aromatic solvent. The mixture is heated to 80° C. with stirring and maintained at that temperature for 20 minutes; then dimethyl oxalate (158.2 g) and octanoic acid (3.7 g) are added and the mixture is heated to 90-120° C. and maintained for 6 hours, followed by vacuum stripping at 90-105° C. at 20 kPa (0.2 bar) with distillation for 30 minutes. Thereafter the temperature is increased to 120-150° C. and maintained for 2-3 hours under vacuum of 85 kPa (0.85 bar). The reaction mixture is cooled and 187 g aromatic solvent is added and stirred for 1 hour at 90° C. to provide the product in solvent.

Corrosion Testing

Lubricants containing certain of the above materials are evaluated in a copper corrosion screen test. The test oil, 90 g, and a cleaned and weighed copper strip are placed into a test tube fitted with a condenser. The test tube is placed into a 150° C. bath for 7 days with 83 mL/min of air purging the sample. At the end of the test, the amount of copper (parts per million) in the test fluid is measured and reported.

The test formulation is a conventional automatic transmission fluid formulation containing 2.5% by weight active chemical (i.e., excluding oil) of the quaternary material (or reference non-quaternary material), except as noted. The other components of the formulation include:

14% by weight dispersant viscosity modifier (incl. 22% diluent oil)
0.6% antioxidant
0.5% corrosion inhibitor (dialkyldimercaptothiadiazole)
0.2 to 0.4% of each of: seal swell agent
fatty acid/polyamine condensate
phosphorus-containing antiwear agent
0.1 to 0.2% of each of: boron-containing friction modifier
overbased metal detergent (including 42% oil)
pour point depressant (including 54% oil)
phosphoric acid (85%)
Smaller amounts of other components
Sufficient oils of lubricating viscosity to total 100%.

The extent of corrosion is shown in the following table:

| Ex. | Added material | anion type | Cu corrosion (ppm) |
|---|---|---|---|
| 1 | Preparative Ex. A | Methyl sulfate | 9, 7, 6, 7, 6[a] |
| 6* | Preparative Ex. F (comparative) | acetate | 339, 214[a] |
| 8* | Example I (comparative, non-quaternary) | — | 177, 71, 338, 332, 371[a] |
| 9* | Prep. Ex. A, part 2, at 2.3% (comparative, non-quaternary) | — | 338 |

-continued

| Ex. | Added material | anion type | Cu corrosion (ppm) |
|---|---|---|---|
| 10 | 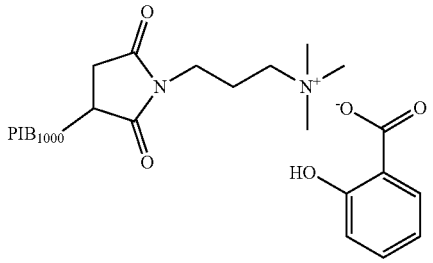 | salicylate | 11 |
| | Preparative Ex. M | | |
| 11 | 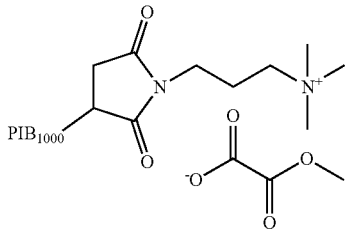 | methyl oxalate | 19 |
| | Preparative Example N | | |
| 12 | 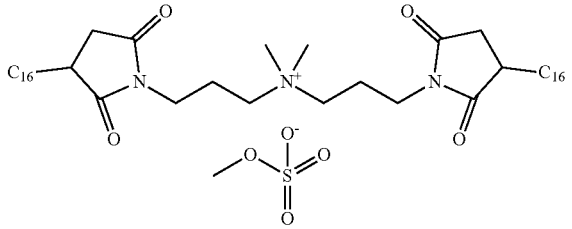 | methyl sulfate | 4 |
| | Preparative Example L | | |
| 13 | 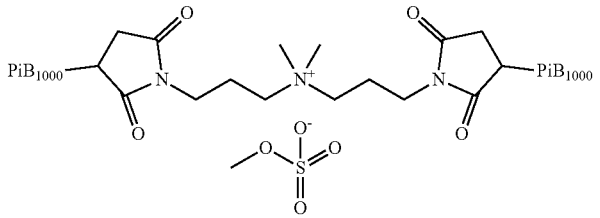 | methyl sulfate | 6 |

[a]multiple runs
*a comparative or reference example

The quaternary materials of the disclosed technology exhibit very low copper corrosion. Corrosion results are particularly good when a quaternary material is combined with a corrosion inhibitor.

The same copper corrosion test is conducted on formulations as described above containing the materials of Preparative Example A or comparative Example I, in varying ratios but at the same total concentration of 3% active component. Results are shown in the following Table:

| Example | Weight ratio Ex A:Comp. Ex. I | Cu corrosion (ppm) |
|---|---|---|
| 14 (comparative) | 0:1.0 | 166 |
| 15 | 0.1:0.9 | 34 |
| 16 | 0.33:0.67 | 14 |
| 17 | 0.5:0.5 | 10 |

-continued

| Example | Weight ratio Ex A:Comp. Ex. I | Cu corrosion (ppm) |
|---|---|---|
| 18 | 0.67:0.33 | 6 |
| 19 | 1.00:0 | 8 |

The results show that the presence of even a small portion of the disclosed quaternary material leads to an unexpectedly significant reduction in copper corrosion.

In another experiment, a lubricant formulation containing 3 percent by weight of a conventional dispersant as in Example I is top treated with amounts of the quaternary material prepared in Example L (amount shown on active chemical basis). The lubricant formulation are subjected to the same copper corrosion test, and the results are as shown in the following Table:

| Example | Amount of Ex. L, % | Cu corrosion (ppm) |
|---|---|---|
| 20 (comparative) | 0 | 470 |
| 21 | 0.2 | 31 |
| 22 | 0.4 | 24 |
| 23 | 0.8 | 22 |

The results show that the presence of the quaternary material affirmatively leads to an improvement in copper corrosion, even without a reduction in the amount of the conventional dispersant.

Friction Testing. Certain of the above formulations are subjected to friction testing using an SAE #2 test rig stand using a clutch pack with a BorgWarner DCT friction lining designated BW™6100, or a friction lining from Dynax, as indicated. The clutch is lubricated with 2 L of test lubricant at 90° C. In this test there are 8 friction surfaces coming into intermittent contact, with a total frictional contact area of 42.6 $cm^2$. The initial engagement speed between the clutch materials is 2300 r.p.m. The other components of the test formulations are the same as described above.

The results, in terms of S1/D ratio are shown in the following Table. The S1/D ratio is the ratio of the static friction coefficient to the dynamic coefficient of friction, the latter being at approximately the midpoint of the engagement process.

| Example | Added material | Anion type | Clutch material | S1/D |
|---|---|---|---|---|
| 24 (comparative) | Preparative Example I | — | Dynax<br>BW6100 | 0.88,<br>0.94 |
| 25 (comparative) | Preparative Example F | acetate | Dynax | 1.08 |
| 26 | Preparative Example A | methyl sulfate | Dynax<br>BW6100 | 0.94,<br>0.96 |

The non-quaternary dispersant of Preparative Example I provides a lubricant with a good S1/D ratio (less than 1.0) but exhibits high copper corrosion, as shown above. The acetate quaternary material of Preparative Example F provides a poor S1/D ratio (greater than 1.0) as well as exhibiting high copper corrosion. The sulfate quaternary material of Preparative Example A, however, provides both a good S1/D ratio as well as very low copper corrosion.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A method for lubricating a driveline device, comprising supplying thereto a composition comprising:

(a) an oil of lubricating viscosity;

(b) 2 to 3.5 wt % of an oil-soluble quaternary ammonium compound comprising a hydrocarbyl-substituted imide or amide, further containing a quaternary nitrogen atom and a hydrocarbylsulfate anion, wherein the quaternary nitrogen is bonded to four carbon atoms by four single bonds;

(c) 0.1 to 1 wt % of a dialkylmercaptothiadiazole compound;

(d) 0.1 to 1 wt % of a dialkyl phosphite compound where each alkyl group independently contains 1 to 10 carbon atoms; and (e) 0.1 to 1.5 wt % of a condensate of a $C_8$ to $C_{24}$ fatty acid and a polyalkylene polyamine.

2. The method of claim 1 wherein the hydrocarbyl-substituted imide or amide is a succinimide or succinamide.

3. The method of claim 1 wherein the hydrocarbyl-substituent of the imide or amide contains about 12 to about 500 carbon atoms.

4. The method of claim 1 wherein the hydrocarbylsulfate anion includes an alkyl group containing 1 to about 30 carbon atoms.

5. The method of claim 1 wherein the hydrocarbylsulfate anion is a methylsulfate anion.

6. The method of claim 1 wherein the quaternary ammonium compound comprises the reaction product of a hydrocarbyl-substituted succinic acid or anhydride and an N,N-dialkylpropylenediamine, which reaction product is quaternized.

7. The method of claim 1 wherein the quaternary ammonium compound comprises a cation represented by the structure

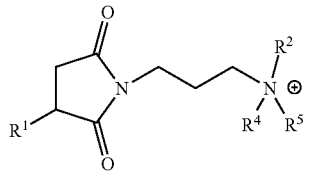

wherein $R^1$ represents a hydrocarbyl group of at least about 16 or at least about 24 carbon atoms, provided that $R^1$ may be attached to the cyclic imide structure by any of a variety of linkages including cyclic linkages and further provided that $R^1$ may be attached to multiple cyclic imide structures;

where in $R^2$ is an alkyl group, a hydroxyalkyl group, or an arylalkyl group; $R^4$ is an alkyl group, and $R^5$ is methyl or ethyl.

8. The method of claim 1 wherein the quaternary ammonium compound comprises a material represented by the structure

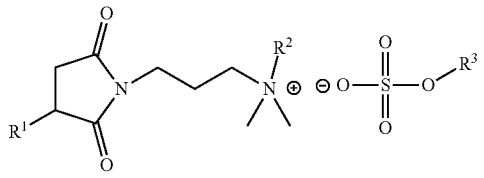

or isomers thereof (or a non-cyclic amide structure corresponding thereto), wherein $R^1$ represents a hydrocarbyl group of at least about 16 or at least about 24 carbon atoms, provided that $R^1$ may be attached to the cyclic imide structure by any of a variety of linkages including cyclic linkages and further provided that $R^1$ may be attached to multiple cyclic imide structures;

wherein $R^2$ is an alkyl group, a hydroxyalkyl group, or an arylalkyl group; and wherein $R^3$ is methyl or ethyl.

9. The method of claim 1 wherein the quaternary ammonium compound comprises a material represented by the structure

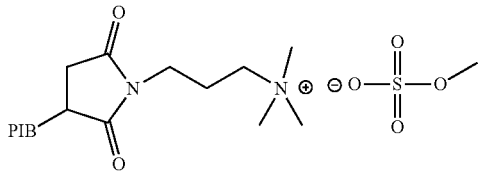

wherein PIB represents a polyisobutene group of about 24 to about 400 carbon atoms.

10. The method of claim 1 wherein the driveline device comprises a wet clutch.

11. The method of claim 1 wherein the driveline device is a transmission.

12. The method of claim 1 wherein the driveline device is a dual clutch transmission.

* * * * *